United States Patent [19]

Loch

[11] Patent Number: 4,614,607

[45] Date of Patent: Sep. 30, 1986

[54] NON-CHROMATED DEOXIDIZER

[75] Inventor: David M. Loch, Seattle, Wash.

[73] Assignee: The Boeing Company, Seattle, Wash.

[21] Appl. No.: 711,943

[22] Filed: Mar. 15, 1984

Related U.S. Application Data

[63] Continuation-in-part of Ser. No. 654,502, Sep. 26, 1984, abandoned.

[51] Int. Cl.[4] ..... C11D 7/08

[52] U.S. Cl. ..... 252/142; 252/79.3; 156/665; 156/667

[58] Field of Search ..... 252/79.3, 142; 156/665, 156/667

[56] References Cited

U.S. PATENT DOCUMENTS

| | | | |
|---|---|---|---|
| 2,719,781 | 10/1955 | Hesch | 252/79.2 |
| 3,106,499 | 10/1963 | Kendall | 252/79.3 |
| 3,228,816 | 1/1960 | Kendall | 252/79.3 |
| 3,275,562 | 9/1966 | Smith | 252/79.3 |
| 3,425,881 | 2/1969 | Cohn | 252/79.2 |
| 3,448,055 | 6/1969 | Mickelson | 252/79.3 |
| 3,622,391 | 11/1971 | Baldi | 252/142 |
| 3,697,332 | 10/1972 | Kuehner | 148/6.15 R |
| 3,932,130 | 1/1976 | Bennett | 148/6.27 |
| 4,220,706 | 9/1980 | Spak | 430/318 |
| 4,222,779 | 9/1980 | Benagli | 148/6.24 |
| 4,225,350 | 9/1980 | Allan | 148/6.27 |
| 4,346,128 | 8/1982 | Loch | 427/405 |
| 4,414,403 | 11/1983 | Schillary | 556/430 |

FOREIGN PATENT DOCUMENTS

| | | | |
|---|---|---|---|
| 1572032 | 7/1980 | United Kingdom | 252/142 |

*Primary Examiner*—Sam Silverberg

*Attorney, Agent, or Firm*—John C. Hammar

[57] ABSTRACT

Improved performance for a deoxidizer solution is achieved by adding ammonium nitrate to a mixture of nitrate, sulfate, and ammonium bifluoride. Gelling or thickening of the deoxidizer is achieved by adding fumed silica to the mixture, with or without ammonium nitrate.

14 Claims, No Drawings

NON-CHROMATED DEOXIDIZER

REFERENCE TO RELATED APPLICATION

This application is a continuation-in-part application based upon U.S. patent application Ser. No. 654,502, filed Sept. 26, 1984 now abandoned.

FIELD OF THE INVENTION

This invention relates to a composition and method for treating unprotected metals and alloys. The composition is particularly useful for cleaning, deoxidizing, activating, and stripping aluminum or aluminum alloys.

BACKGROUND OF THE INVENTION

Aluminum and aluminum alloy metals are used in a variety of settings where they are subjected to wear and corrosion. After being cast or formed into desired shapes, aluminum surfaces usually receive protective coatings, such as layers of aluminum oxide, paint, or wax, to resist wear or corrosion.

Before protective coatings are applied, the metal is generally treated by degreasing, alkaline cleaning, rinsing, and deoxidizing the surface.

A deoxidized aluminum surface may be anodized to convert surface aluminum metal to corrosion resistant aluminum oxide. Alternatively, after deoxidation, an aluminum surface may be treated to form an oxidation or layer containing metal salts on the aluminum surface. Two commonly used solutions for surface protection are marketed under the trademarks ALODINE and IRIDITE. Each solution contains chromic acid. After anodizing or conversion coating has been completed, a paint, wax, or other additional protective coatings may be applied.

Corrosion resistance of aluminum is dependent, in part, on successfully deoxidizing of the surface prior to conversion coating or anodizing. Successful deoxidizing requires a thoroughly clean surface free from grease, coatings, or other impurities. In addition, the surface should be activated to homogenize the receptivity of the surface to subsequent protective coatings.

Deoxidation usually is achieved with chromated acid solutions, but these solutions are ineffective at removing smut, caused by caustic solutions. In particular, chromated deoxidizers have difficulty in removing smut on cast alloys or weld zones on aluminum weldments. Brushing has ordinarily been necessary to remove smut from the aluminum after deoxidizing.

Chromated acid deoxidizing solutions are environmentally undesirable and the Environmental Protection Agency (EPA) has enacted regulations which restrict chromium effluents. Consequently, in more and more metal finishing facilities, chromium treatment plants are being installed at costs of approximately $350,000. Annual operating costs of each plant is presently about $30,000/year. Still, restrictions on solid chromium disposal make its handling expensive.

Nonchromated deoxidizing solutions are known, but water contamination usually causes these nonchromated deoxidizers to lose quickly their ability to desmut aluminum alloy metals. One nonchromated deoxidizing solution is described in U.S. Pat. No. 4,346,128, and includes a mixture of 50 vol % $HNO_3$ (40°–42° Baume, O-N-350), 25 vol % $H_2SO_4$ (66° Baume, O-S-809), 25 vol % $H_2O$, and 1 lb/gal ammoniumfluoride (usually ACTANE 70 from Enthone, Inc.). This solution has an etch rate of about 0.9 mil/surface-hr on A357 cast aluminum, and can remove smut from aluminum.

Enthone, Inc. promotes mixtures of nitric acid, sulfuric acid and ammoniumbifluoride for etching glass and pickling titanium.

SUMMARY OF THE INVENTION

The chromium-free composition of the present invention provides in all-purpose bath that may be used to clean, deoxidize, strip, and activate metal surfaces, such as aluminum metal, before anodizing, conversion coating, or applying other protective coatings on the surface. The bath can effectively remove smut resulting from etching, milling, and shot peening even from silicon rich aluminum alloys and weldments. These compositions have a longer useful life than many chromated solutions. When used to treat aluminum, the alkaline cleaning and subsequent rinse steps normally used may be eliminated in many cases. Separate caustic etching and deoxidizing steps may also be eliminated.

These compositions can effectively remove oxides, scale, corrosion, residual penetrant dyes remaining after surface crack inspections, residual resins used to seal porous substrates, and residual silicon greases remaining after vacuum leak testing. Anodizing layers and chemical conversion coatings, such as ALODINE and IRIDITE, can also be removed. A clean, smooth, uniformly receptive surface needed for effective conversion coating results.

The invention is directed to a composition suitable for treating metals comprising an acidic nitrate solution, sulfuric acid, and ammonium bifluoride, and preferably, ammonium nitrate or another soluble nitrate salt.

The invention is also directed to a method of treating metal comprising the steps of immersing the metal in the composition for a time sufficient to treat the metal, and removing the metal from the composition.

A gelled deoxidizer comprises an aqueous solution of nitric acid, sulfuric acid, ammonium biflouoride, and fumed silica. The gelled deoxidizer is useful for cleaning aluminum products which do not admit to immersion in a bath. A preferred composition consists of 415–560 g/l $HNO_3$, 375–505 g/l $H_2SO_4$, 38–52 g/l $NH_3F_2$, 0.25–0.36 l $H_2O$, and 0.6–2.5 l CAB-O-SIL, grade M-5 fumed or pyrogenic silica. Basically, this gel is a thickened treating solution.

DETAILED DESCRIPTION OF THE INVENTION

Although the present invention is useful on a variety of metals, especially Group III metals other than aluminum, such as Boron, Gallium, Indium, Titanium, and their alloys, it is illustrated in this specification for aluminum metals, its principal use. For treating other metals in this group, the preferred ranges probably must be adjusted to lower the nitric acid concentration and to increase the fluoride concentration.

The chromium-free deoxidizer comprises an acidic nitrate solution, sulfuric acid, and ammonium bifluoride. Preferably, the acidic nitrate solution is nitric acid, a buffered acidic nitrate solution, or a combination thereof. Technical or reagent grade nitric acid is preferred: 42° Baume nitric acid with a concentration of about 40–42 weight percent is most preferred for solution make-up.

A buffered acidic nitrate solution includes any suitable soluble nitrate salt in dilute $H_2SO_4$. Representative nitrate salts include ammonium nitrate, sodium nitrate, and potassium nitrate. The buffered acidic nitrate solution is particularly advantageous in that it suppresses $NO_x$ fuming and is cheaper than nitric acid. It may be used alone or in combination with nitric acid.

The sulfuric acid for solution make-up may be any commercially available technical or reagent grade, preferably, 51° Baume sulfuric acid with a concentration of about 64–65 weight percent.

Preferably granulated ammonium bifluoride is used.

The deoxidizer may be made by mixing nitric and sulfuric acid and then adding the granulated ammonium bifluoride.

If buffered acidic nitrate solution is used, nitrate salts sufficient to obtain the desired nitrate normality in the final solution is dissolved in a portion of the sulfuric acid before additional sulfuric acid is added to achieve the desired level of sulfate ion. Ammonium bifluoride is then added.

The concentration of nitrate ion from nitric acid or the nitrate solution is between about 1.5–14.0N; preferably, between about 4.5–8.0N; and more preferably, between about 6.7–8.0N. These normalities include the contribution of ammonium nitrate which is added to improved performance of the solution, as will be explained.

The concentration of sulfate ion is between about 2.5–15.0 N; preferably, between about 5.5–12.0N, and, more preferably, between about 8.4–11.1N.

The pH of the composition is on the order of 1. The appropriate normality for the sulfate and nitrate ions in the solution is selected largely on the basis of the alloy being treated, the desired substrate etch rate, and the preferred contact time.

In general, higher nitrate ion normality provides a lower etch rate, and tends to reduce the effectiveness of the composition as a deoxidizer. High nitrate ion normality is most useful with aluminum metal that has a low silicon content.

Lower normalities of sulfate ion slow the deoxidizing time, making it difficult to deoxidize high silicon alloys effectively. Lower sulfate ion normality solutions are therefore most useful with wrought alloys.

Ammonium bifluoride (AMB) is preferably added to the composition in an amount between about 0.5–16 oz/gal of the composition. The appropriate concentration of AMB will depend on the alloy being treated. Wrought alloys may require only about 0.5 oz/gal, while silicon rich alloys require about 4 oz/gal. Certain cast alloys or alloys having a high percentage of alloying ingredients may require up to about 16 oz/gal.

The etch rate of 100 gallons of solution containing 25 lbs AMB is about 0.2 to 0.8 mil/surface/hour on A357 cast aluminum and about 0.1 to 0.4 mil/surface/hour on clad or bare wrought alloys.

The concentrations of nitrate and sulfate ions are monitored by titration or by pH metering and are maintained within the control ranges by supplying fresh nitrate solution, sulfuric acid, or ammonium bifluoride, as needed.

Preferably, $NH_4NO_2$ (ammonium nitrate) is used to enhance both the effectiveness of the composition and its useful life by suppressing the etch rate, although its mechanism is not well understood. With ammonium nitrate, the color intensity and uniformity of subsequently applied conversion coatings are suprisingly improved, especially on aluminum castings. The ammonium bifluoride consumption is reduced. Other nitrate additives having compatible cations may be used to extend the work-life of the solution, such as sodium or potassium nitrate. Calcium, aluminum or other nitrates which are only slightly soluble are ineffective.

Ammonium nitrate apparently increases the nitrate ion concentration to enhance the deoxidizing capacity of the solution without increasing the acidity of the solution. The ammonium cation competes with the hydrogen ion and functions as a solution buffer. The cation of the nitrate salt should be soluble in the solution and compatible in that it does not react to form undesirable by-products. Mixtures of nitrate salts can be added, if desired.

Addition of nitrate salts reduces the generation of noxious $NO_x$ fumes upon immersion or extraction of parts from the bath.

When the acidic nitrate solution is nitric acid, the ammonium nitrate may be present in amounts up to about 100 g/l of the composition. Greater amounts, up to the solubility limit of ammonium nitrate in the composition, may be used when buffered nitrate solution is used.

Control of ammonium nitrate is important for certain alloys. For example, between about 8–20 g/l will produce beneficial results when wrought alloys are deoxidized in a composition having nitric acid, but above 20 g/l hinders deoxidizing and may be undesirable.

When properly used, the lower etch rate that results from using ammonium nitrate causes a slower rate of metal buildup in the solution, enhances the removal of surface alloying constituents, and helps produce a homogeneous, activated surface, which results in improved color intensity and uniformity of subsequently applied conversion coatings.

Ammonium nitrate (AMN) decreases consumption of ammonium bifluoride. Without AMN, aluminum is precipitated primarily as $AlF_3$. With AMN, aluminum precipitates primarily as $AlF(OH)_2$. Hence, about ⅓ less flouride is consumed with AMN present, saving about $0.66 for each gallon of the solution.

AMN is not consumed, but should be added as needed to compensate for solution volume increases caused by chemical additions which would otherwise reduce the ammonium ion concentration.

In a typical bath about 8.4 pounds AMN and 25 pounds ammonium bifluoride are dissolved in 100 gallons of a solution made up of 50 gallons of 42° Baume nitric acid (40–42 weight percent) and 50 gallons of 51° Baume sulfuric acid (64–64 weight percent).

The consumption rate of ammonium bifluoride is lowest for low silicon wrought alloy treatment, increases for desmutting low silicon wrought alloys, is higher still for deoxidizing aluminum castings, and is highest for desmutting aluminum castings.

In 100 gallons of composition, addition of 12.5 pounds of ammonium bifluoride has been found desirable for replenishment of the solution after the treatment of 1,000 square feet of surface area to desmut aluminum castings.

The compositions are preferably kept at ambient temperatures ranging between 60 and 90 degrees Fahrenheit. Therefore, heating or cooling equipment or temperature sensors are not required. The composition may be heated, however, to temperatures below that at which nitrate ions decompose to $NO_x$. The composition may be cooled, but the deoxidizing rate will decrease.

Although the contact time necessary for complete cleaning, deoxidation, and activation is different for different alloys, wrought aluminum alloys may be effectively deoxidized in about 1-3 minutes, while 10-30 minutes are typically required with standard chromated solution.

One unexpected advantage of the present invention is its stability and long work life, which provides a significant savings over other deoxidizing solutions. A chromated deoxidizing solution loses its function due to a build up of reaction by products and must be discarded. As the composition of the present invention is used and replenished, however, the concentration of sulfates, nitrates, and fluorides seems to serve to buffer the solution, and destructive by-products are avoided or are precipitated. The presence of impurities, such as oils and greases, or the build-up of precipitated aluminum salts leads to loss of effectiveness, but the solution can be replenished if filtered or decanted. For chromated deoxidizing solutions, the effectiveness declines when the concentration of dissolved aluminum cations exceeds about 10 g/l. Then, conversion coated samples fail ASTM B117 salt spray tests. With the chromate-free solution of this invention, the measured concentration of aluminum cations remains at less than about 1.5 g/l, so little failure occurs in spray testing. Aluminum salts precipitate at these low concentrations in the chromium-free bath.

The deoxidizing or etch rate of a deoxidizing solution is another important factor in determining its acceptibility. Etching wears away the surface of aluminum and aluminum alloy metals. Some etching may be desired to expose fresh aluminum metal, but excessive etching may cause some parts to fall outside size tolerances. Prior art chromate-free deoxidizers using strong acids and fluoride salts soon reach unacceptable etch rates because of progressive dilution of the solution with entrained water on parts when they are immersed. This entrained water apparently allows greater dissociation of the salts and creates a stronger acid. With the non-chromated deoxidizer of the present invention, the etch rate remains stable even when water entrainment occurs, and the bath is less sensitive to the concentration of water.

Conventionally, the cleaning cycle for aluminum consists of degreasing, alkaline cleaning, rinsing, and deoxidizing. The alkaline cleaning step may be eliminated on sheet stock alloys which are coated with corrosion protective oils when using the composition of the present invention.

Many alkaline cleaners contain complex silicates which are difficult to rinse from the parts. Residual silicates on the parts cause spotty or otherwise non-uniform coverage of subsequently applied conversion coatings. Nonuniform corrosion resistance of the coatings may result.

Eliminating the alkaline cleaner step also reduces energy and material costs associated with heaters required to maintain the alkaline treatment bath at a temperature between about 140°-180° F.

The following Examples are provided to illustrate the invention.

EXAMPLE 1

Ammonium Nitrate Performance

One ten gallon aliquot of fresh composition was prepared by adding 5 gallons of 51° Baume technical grade sulfuric acid and 2.5 pounds of technical grade ammonium bifluoride to 5 gallons of 42° Baume nitric acid at ambient temperature. Similar wrought alloy test samples were immersed in the aliquot for three minutes. Cast alloy samples were immersed for five minutes. After treatment, the samples were rinsed in cold water, immersed in an ALODINE chemical conversion coating bath for 3 minutes, and rinsed again for 1-5 minutes. After the bath had expired (its rate of deoxidizing had reached an unacceptably low rate), the bath was replenished by adding ammonium nitrate, and additional test samples were immersed. Replenishment continued in accordance with the cumulative addition of AMN shown in Table 1. The etch rate suppression caused by AMN was measured. The wrought samples were 2024, 6061 and 7075 aluminum alloys, while the cast samples were A356 aluminum. Each coating was tested by a conventional salt spray corrosion test. The results were:

TABLE 1

| Ammonium Nitrate (AMN) (grams/liter) | Substrate Etch Rate Suppression (percent) | Quantity of Panels Passing Salt Spray Test* |
|---|---|---|
| 5 | 6.9 | 12 of 12 |
| 7 | 10.8 | 11 of 12 |
| 10 | 15.4 | 12 of 12 |
| 20 | 30.5 | 12 of 12 |

*3 panels of each alloy tested per ASTM B117

At 10 grams/liter concentration of ammonium nitrate, it costs about $0.03/gallon to use AMN, and saves about $0.88/gallon because of the decreased consumption of ammonium bifluoride and extended work life. AMN addition does not significantly effect the quality of the final parts.

At about 20 grams/liter AMN concentration, the deoxidizing action on wrought alloys begins to be impaired and the resultant surface treatment appears nonuniform. AMN addition does not reduce the corrosion resistance of the finished parts, as shown in Table 1.

EXAMPLE 2

Pilot Plant Test Results 1200 gallons of fresh solution were prepared by adding 600 gallons of 51° Baume technical grade sulfuric acid and 300 pounds of technical grade ammonium bifluoride to 600 gallons of 42° Baume nitric acid. A mixed workload of about 250 to 800 square feet per day of A356 and A357 smutted, aluminum castings and 2024, 6061, and 7075 wrought and forged aluminum alloys (which had heat treatment scale and/or surface corrosion products) was treated in the solution. Typical immersion times at ambient temperature were 8 to 10 minutes for castings and 1-3 minutes for wrought and forged alloys. The chemical addition schedule and solution controls of Table 2 was followed. All parts were found to have a uniformly clean, white, matte appearance after immersion in the solution, indicating successful treatment.

Salt spray corrosion testing was conducted periodically per ASTM B117 on representative test speciments having ALODINE chromatic conversion coatings. Passing results were achieved consistently.

TABLE 2

| Cumulative Usage Days | Normality Before Chemical Additions $NO_3$— | $SO_4$— | Chemical Additions to 1200 gallons $HNO_3$ (gal) | $H_2SO_4$ (gal) | AMB (lbs) |
|---|---|---|---|---|---|
| 1 | 7.1 | 9.6 | — | — | — |
| 10 | 7.1 | 9.1 | 25 | 50 | 30 |
| 17 | 6.7 | 9.7 | 75 | 75 | 30 |
| 24 | 7.1 | 9.8 | 25 | 30 | 50 |
| 31 | 7.2 | 9.5 | — | — | 40 |

EXAMPLE 3

Corrosion Resistance Comparison

The composition of Example 2 was used over an extended period with partial volumes of the composition being periodically purged and new feedstocks added to maintain the concentrations of nitrate and sulfate ions within the preferred ranges. Ammonium bifluoride was added at a rate of about 0.04 to 0.2 oz AMB/$fl^2$ of treated aluminum. After treatment in the composition, the alloys were subsequently conversion coated in ALODINE 600 chemical converstion coating sold by the Amchem Co., Ambler, PA. Test panel sizes were $0.04\times3\times10$ in. The test results for salt spray corrosion resistance are listed in Table 3. Exceptional performance (100% pass) was exhibited.

TABLE 3

| Cumulative Operation (Days) | Alloy | Immersion Time (Min.) | Salt Spray Test (ASTM B117) Number Pass | Number Fail |
|---|---|---|---|---|
| 1 | 2024 | 1 | 3 | 0 |
| | | 2 | 3 | 0 |
| | | 3 | 3 | 0 |
| | 6061 | 1 | 3 | 0 |
| | | 2 | 3 | 0 |
| | | 3 | 3 | 0 |
| 19 | 2024 | 3 | 3* | 0 |
| | | 10 | 3* | 0 |
| | 6061 | 3 | 3* | 0 |
| | | 10 | 3* | 0 |
| | 7075 | 3 | 3* | 0 |
| | | 10 | 3** | 0 |
| 36 | 2024 | 1 | 3 | 0 |
| | | 2 | 3 | 0 |
| | | 3 | 3 | 0 |
| | 6061 | 1 | 3 | 0 |
| | | 2 | 3 | 0 |
| | | 3 | 3 | 0 |
| | 7075 | 1 | 3 | 0 |
| | | 2 | 3 | 0 |
| | | 3 | 3 | 0 |
| 88 | 2024 | 1 | 1 | 0 |
| | | 2 | 1 | 0 |
| | | 3 | 1 | 0 |
| | 6061 | 1 | 1 | 0 |
| | | 2 | 1 | 0 |
| | | 3 | 1 | 0 |
| | 7075 | 1 | 1 | 0 |
| | | 2 | 1 | 0 |
| | | 3 | 1 | 0 |
| 129 | 2024 | — | No Test | |
| | 6061 | — | No Test | |
| | 7075 | 1 | 3 | 0 |
| | | 2 | 3 | 0 |
| | | 3 | 3 | 0 |
| 151 | 2024 | — | No Test | |
| | 6061 | — | No Test | |
| | 7075 | 1 | 3 | 0 |
| | | 2 | 3 | 0 |
| | | 3 | 3 | 0 |

*All panels tested 336 hours (Pass at 168 hours is acceptance requirement).
**Failed after 168 hours For purposes of comparison, a commonly used, commercially available chromated deoxidizer bath was simultaneously operated for the same alloys as shown in Table 3. Deoxidized test panels of 7075 alloy were coated in the same solution. Only 74% passed the salt spray test showing the superior performance of the composition of the present invention.

EXAMPLE 4

Buffered Nitrate

A buffered nitrate solution was prepared by adding 488 grams/liter of ammonium nitrate to a 51° Baume sulfuric acid solution to form a 5.5N $NO_3$—solution. This buffered solution performed analogously to the nitric acid solution, but the solution was less expensive to make up. Other $NO_3$— concentrations of differing normality can be made up in this way.

EXAMPLE 5

Life Expectancy Tests

Ten gallons of the solution of Example 2 were used until the composition became ineffective at desmutting aluminum castings. The nitrate and sulfate ion concentrations at which the solution lost its maximum effectiveness were noted, and make-up acids and ammonium bifluoride were added to replenish the bath. When maximum effectiveness was lost for each solution, the work-life of the solution was calculated by dividing the surface area of the treated samples treated to that point in the solution by the actual volume of the solution to determine the effective treatment area/unit volume.

TABLE 4

| Solution Work-Life ($Ft^2$/gal) | Acid Normalities of the Deoxidizer when Optimum Effectiveness Lost: Nitrate Ion Normality | Sulfate Ion Normality |
|---|---|---|
| 22 | 7.3 | 8.4 |
| 42 | 6.7 | 8.5 |
| 55 | 6.4 | 8.2 |
| 81 | 6.1 | 7.0 |

The deoxidizer can be gelled for use on parts which cannot be immersed in a bath. This gel preferably includes between about 415–560 g/l nitric acid, about 375–505 g/l sulfric acid, about 38–52 g/l ammonium bifluoride, about 0.25–0.36 liters deionized or distilled water/liter of solution, and about 0.6–2.5 liter of CAB-O-SIL, grade M-5 fumed silica/liter of solution. Thus, the gel is basically a thickened deoxidizer. Preferably the solution includes 488 g/l $HNO_3$, 440 g/l $H_2SO_4$, 0.25 l $H_2O$/liter of solution, and 1.2 l fumed silica/liter of solution. The solution can be mixed in a flask of known volume by adding the formed silica to predetermined amounts of mixed nitric and sulfuric acids and adding $H_2O$ to reach the desired final volume. The ammonium biflouoride may be dissolved in the solution prior to the final addition of water.

This gelled deoxidizer need not include ammonium nitrate, since enhanced work life is unimportant in most circumstances. Of course, ammonium nitrate could be added, if desired.

To clean a part, the gel is applied to the surface for 5–20 min, much like "Naval Jelly" (phosphoric acid in a thickener). It is removed by rinsing the part with water. The gel should have a longer shelf life than "Naval Jelly". Formed silica ($SiO_2$) is also called pyrogenic silica. It is colloidal and is formed by hydrolysis of silicon tetrachloride in an oxygen-hydrogen flame. When added to polar solvents like water the formed silica thickens the solution by forming hydrogen bonds. CAB-O-SIL ® is a registered trademark of the Cabot Corp. Fumed silica is a well-known thickener with a prolonged life.

While preferred embodiments have been described, those skilled in the art will readily recognize modifications which might be made to the embodiments without departing from the inventive concept. Therefore, the description and claims should be construed broadly to protect the invention without unnecessary limitation. The examples are illustrations rather than limitations. The claims should be construed liberally and should be limited only as is necessary in view of the pertinent prior art.

I claim:

1. A deoxidizer for cleaning metals, particularly aluminum and aluminum alloys comprising an aqueous solution of nitric and sulfuric acid made by mixing the acids or their salts to provide about 1.5–4.0N $NO_3^-$, 2.5–15.0N $SO_4^=$ about 0.5–16 oz/gal ammonium bifluoride, and an effective buffering amount of a nitrate salt to slow the rate of ammonium bifloride consumption.

2. The deoxidizer of claim 1 wherein the nitrate salt has a concentration of between about 8–100 g/l.

3. The deoxidizer of claim 2 wherein the concentration of $NO_3^-$ is between about 4.5–8.0N and the concentration of $SO_4^=$ between about 5.5–12.0N.

4. The deoxidizer of claim 3 wherein the concentration of $NO_3^-$ is between about 6.7–8.0N and the concentration of $SO_4^=$ is between about 8.4–11.1N.

5. The deoxidizer of claim 4 wherein the concentration of ammonium bifluoride is between about 4–16 oz/gal, the nitrate salt is ammonium nitrate, and the concentration of ammonium nitrate is about 8–20 g/l.

6. A deoxidizer for cleaning metals, particularly aluminum and aluminum alloys, comprising an aqueous solution prepared by mixing equal volumes of 51° Baume $H_2SO_4$ and 42° Baume $HNO_3$ with about 0.25–1 lb/gal ammonium biflouride and adding about 5–20 g/l ammonium nitrate.

7. A deoxidizer for cleaning metals, particularly aluminum and aluminum alloys, comprising an aqueous solution prepared by adding sufficient nitrate salt to 51° Baume $H_2SO_4$ to achieve a normality of $NO_3^-$ of between about 1.5–14.0N and about 0.25–1 lb/gal ammonium bifluoride.

8. The deoxidizer of claim 7 wherein the nitrate salt is ammonium nitrate.

9. The deoxidizer of claim 1 further comprising a predetermined amount of a thickener.

10. The deoxidizer of claim 9 wherein the thickener is fumed silica.

11. The deoxidizer of claim 5 further comprising about 0.6–2.5 liters of fumed silica/liter of solution.

12. The deoxidizer of claim 8 further comprising about 0.6–2.5 liters of fumed silica/liter of solution.

13. A method for deoxidizing aluminum or aluminum alloy comprising the steps of immersing the aluminum or alloy in a solution as defined in claim 6 for a sufficient time to deoxidize the surface and removing the aluminum or alloy from the solution.

14. A method for deoxidizing aluminum or aluminum alloy comprising the steps of immersing the aluminum or alloy in a solution as defined in claim 7 for a sufficient time to deoxidize the surface and removing the aluminum or alloy from the solution.

* * * * *